United States Patent [19]

Dupuis

[11] Patent Number: 4,657,402

[45] Date of Patent: Apr. 14, 1987

[54] LOOSENING OF COMPACTED MATERIAL IN A SILO

[75] Inventor: Bruno Dupuis, Quebec, Canada

[73] Assignee: Construction Acton Ltee, Acton Vale, Canada

[21] Appl. No.: 771,239

[22] Filed: Aug. 30, 1985

[51] Int. Cl.[4] ..... B65G 65/46

[52] U.S. Cl. ..... 366/349; 222/63; 222/228

[58] Field of Search ..... 366/349; 222/63, 227, 222/228; 414/324

[56] References Cited

U.S. PATENT DOCUMENTS

| | | | |
|---|---|---|---|
| 3,037,713 | 6/1962 | Carroll | 222/228 X |
| 3,424,350 | 1/1969 | Herr et al. | 222/63 |
| 3,828,947 | 8/1974 | Lepley | 222/228 X |
| 3,837,507 | 9/1974 | Lepley et al. | 222/228 X |
| 3,907,131 | 9/1975 | Lepley | 222/228 X |

*Primary Examiner*—Louis K. Rimrodt

*Attorney, Agent, or Firm*—Robic, Robic & Associates

[57] ABSTRACT

A vertical rotary post in a silo is formed with a transverse passage across and into which a stop sleeve is fixed. A chain, for loosening compacted material in the silo, extends freely through the passage. The chain has a ring, at one end, which extends into the passage but is stopped by the stop sleeve.

9 Claims, 5 Drawing Figures

LOOSENING OF COMPACTED MATERIAL IN A SILO

The present invention relates generally to a discharging mechanism for use in unloading a silo filled with packed material, the silo being of the bottom discharge type.

In this type of silo, an example of which is disclosed in Canadian Pat. No. 857,173 of Dec. 1st 1970 and its U.S. Pat. No. 3,424,350 of Apr. 28, 1967, an auger is used to agitate the stored silage and direct it toward a discharge opening where it may be picked up by an electrically powered discharge mechanism. This auger includes a vertical rotary post or shaft and one or preferably several agitating chains, having inertia blocks at one of their ends, secured to the post to assist in loosening the wet material that has compacted in the silo.

As the post starts to rotate, the auger gradually feeds the material which immediately surrounds it through the discharge bottom opening, the loosening chain then keeping close to the auger. After a while, and under the action of the centrifugal force, the chains become horizontal with the result that a hollow space is created between the bottom of the silo and the bottom surface of the loaded compacted material, this bottom surface of the material bridging over the silo in the form of an arch. At that time, the full mass of the compacted material moves down slowly by gravity if the agitating chains and auger are kept rotating. When one or more of the chains break, the shaft and auger are stopped so that the mass of silage also comes to a standstill, being held stationary by the arch formed by the compacted mass.

According to present practice, someone then enters into the silo through an access opening provided at the bottom and into the aforesaid space between the silo bottom and the arch formed by the loaded material. He then proceeds to repair or replace any damage parts.

As will readily be understood, this is quite a dangerous practice as the loaded mass may suddenly break at the bottom arch, like an avalanche, and fall upon the repair man, often causing his death by suffocation.

It is therefore a main object of the invention to provide a method and means of mounting the above-mentioned compacted material loosening chains on the rotary post such as to make it unnecessary to enter the aforementioned dangerous hollow space created between the bottom of the silo and the arch formed at the bottom of the stored mass of silage.

More specifically, and according to one aspect of the present invention, there is provided a method of removably mounting a compacted-material loosening chain having a predetermined transverse size on a post vertically extending from the bottom of a silo constructed for bottom unloading, said method essentially comprising:

mounting a ring, having a predetermined diameter greater than said chain transverse size, at one end of said chain;

providing, across said post, a passage having a diameter greater than said ring predetermined diameter;

providing, in said passage, a stop means bored to a diameter smaller than said ring predetermined diameter and greater than said chain transverse size, and threading said chain, from the other end thereof, through said passage until said ring enters said passage and comes to butt against said stop means.

According to a further aspect, the invention is a combination essentially comprising:

a post vertically extending from the bottom of said silo;

a compacted material loosening chain having a predetermined transverse size;

a ring mounted at one end of said chain, said ring having a diameter greater than said chain transverse size;

means defining a passage across said post, said passage having a diameter greater than said ring diameter;

stop means, within said passage, said stop means having a central bore with a diameter smaller than said ring diameter and greater than said chain transverse size;

wherein said chain extends out of said passage from one end of said passage and said ring lies within said passage in abutment against said stop means.

An embodiment of both the above-mentioned method and combination will now be described with reference to the appended drawings wherein.

Figure 1:
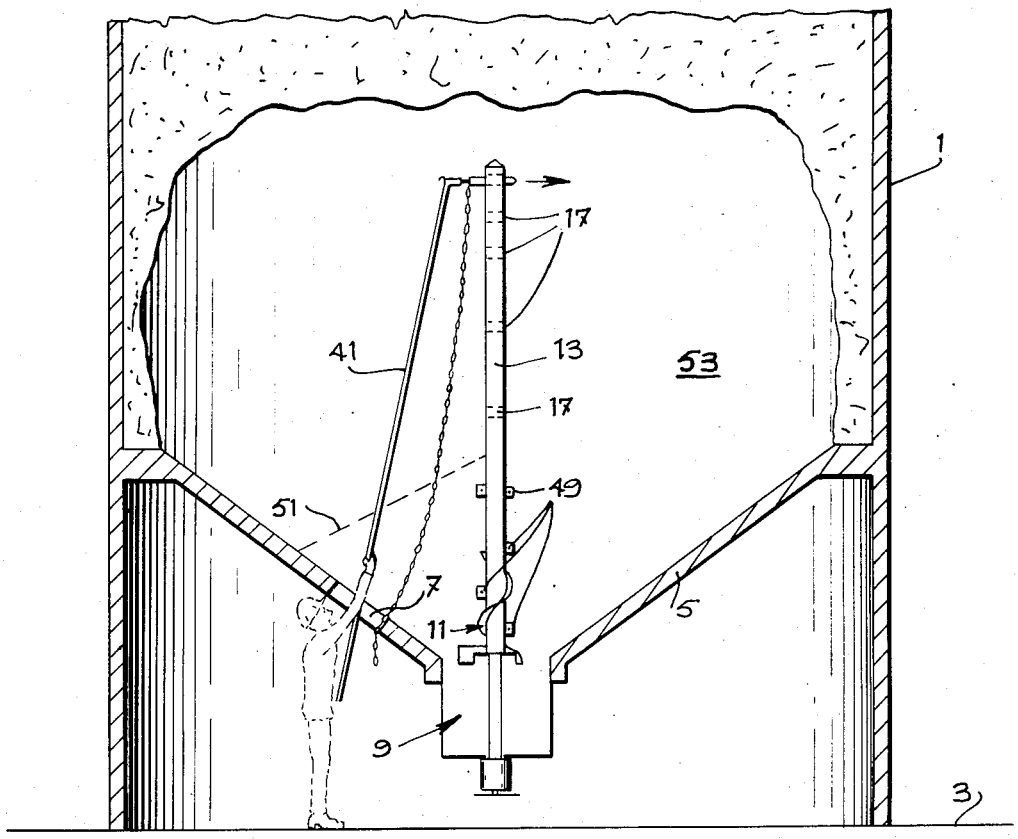
FIG. 1 is a diagrammatic vertical cross-sectional view of a bottom discharging silo with the improved material loosening means of the invention.

With reference to FIG. 1, the silo comprises a cylindrical shell 1 resting on the ground 3 and having a conical bottom wall 5 provided with a standard opening 7 for access into the silo.

A discharge assembly and mechanism 9 is provided which is of conventional type such as disclosed in the aforementioned patents.

The discharge assembly comprises an auger 11 including an upstanding post or shaft 13 brought into rotation by the motor (not shown) of the discharge assembly 9. As this type of auger 11 is well known, no further description will be given.

Figure 2:
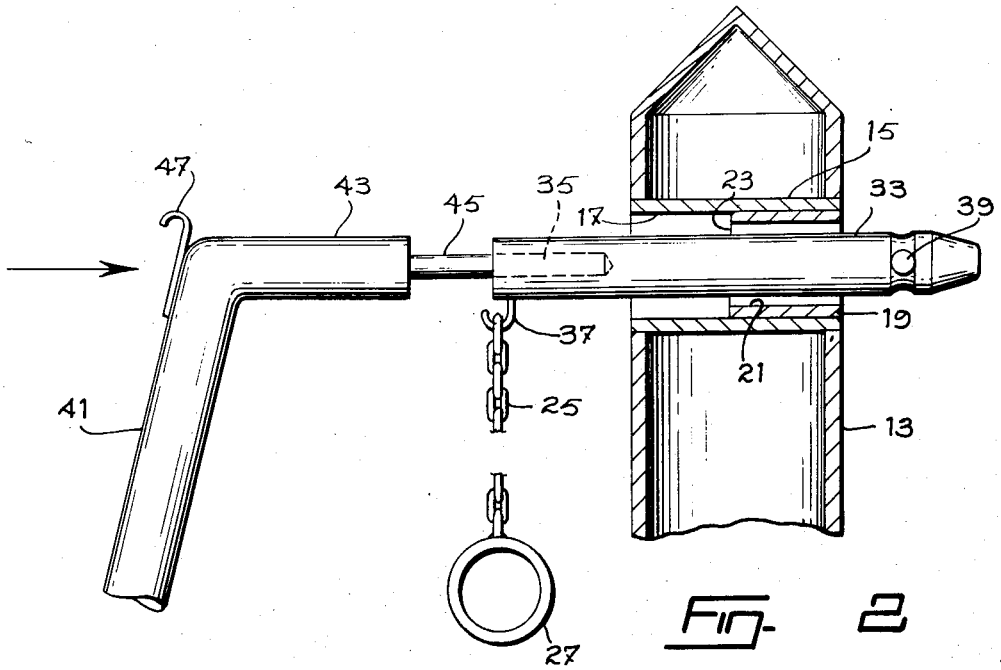
FIG. 2 is a side elevation view, partly in vertical cross-section, of the upper part of the post.
Figure 5:
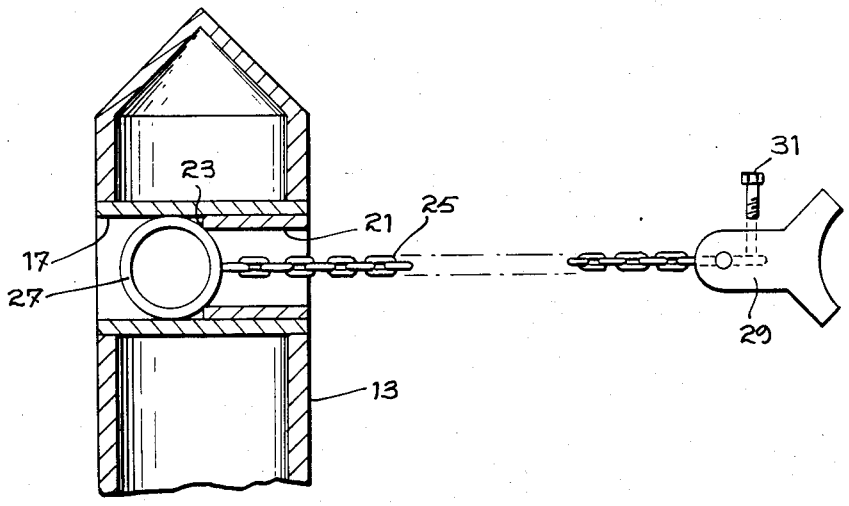
FIG. 5 is a partial side elevation view of the post and loosening chain assembly in the final mounting step.

As best shown in FIGS. 2 and 5, the post 13 which may be hollow or solid is provided with a first transverse sleeve 15 defining an inner passage 17 into which is secured an inward sleeve 19 having a bore 21. A stop shoulder 23 is thus defined between the inner passage 17 and the bore 21.

The means for loosening the compacted material in the silo comprises a chain 25 which, as readily seen in FIG. 5, has a size substantially smaller than the diameter of the bore 21. The loosening means further comprises a ring 27, preferably of circular cross-section, mounted at one end of the chain 25 while a standard inertia block 29 is removably fixed to the other end of the chain in any known manner as by means of the screw 31.

For mounting the material loosening assembly formed of chain 25 and ring 27, use is made of a needle 33 best illustrated in FIG. 2. It has a blind axial hole 35 at one end, a radially extending hook 37 at the same end and a pair of through transverse holes 39 at the other end.

From the above description, it will be seen that the chain 25 can easily be threaded through the passage 17 in its counter bore 21 from one side of the rotary post 13 and pulled from the other side, drawing with it the ring 27 which then easily slides into the passage 17 to finally abut the shoulder 23 as clearly shown in FIG. 5. The aforementioned assembly can easily be carried out in the manner shown in FIG. 1 while the repairman stands outside the silo and with the help of a pole 41 which, as illustrated in FIG. 2, has an outwardly turned arm 43 to which is secured, in any known manner, a pin 45. A small hook 47 is also provided at the elbow between the main part of the pole 41 and its arm 43.

With the above equipment in mind, the loosening chain assembly 25, 27, is releasably mounted on the rotary post 13.

Figure 3:
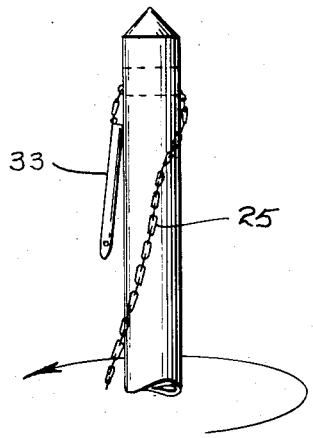
FIGS. 3 and 4 are partial elevation views showing two successive steps of mounting a material loosening chain according to the teaching of the invention.
Figure 4:
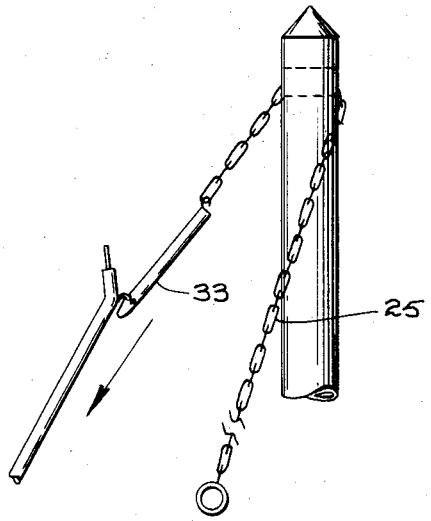

As shown in FIG. 2, the last link of the chain 25 is first slid on the hook 37 and the pin 45 entered into the blind axial hole 35 of the needle 33. The needle 33 is then easily slid or pushed into the passage 17 and the bore 21. Thereafter, the pin 45 is removed from the blind hole 35 and the post 13 rotated by 180°. The hook 47 of the pole 41 is then slid into the hole 39 at the forward end of the needle 33 and, by pulling on the needle, the latter is moved out of the passage 17 and, by further pulling on it, the chain may be threaded through the passage 17, as shown in FIGS. 3, 4 and 5, until the ring 27 comes to butt against the shoulder 23. At that time, the needle 33 which is no longer needed is removed and the inertia block 29 is secured at the free end of the chain.

While only one chain assembly 25, 27, has been described, there may be several such assemblies used each having its own through passage 17, and bored sleeve 21, as shown in FIG. 1. The mounting of the chain assemblies as well as the securing of the inertia blocks 29 being the same as described above.

As above-described, the particular combination of compacted material loosening chain assemblies 25, 27, and passage means 17, 21, do lend themselves very easily to the mounting of such assemblies on the vertical post 13 of the auger 11.

Removal of an already mounted chain assembly 25, 27, can easily be obtained by gripping the ring 27 with the hook 47 of the pole 41 and, after having removed the inertia block 29, drawing the ring 27 and the chain 25 out of the passage 17 in its counter bore 21.

In this manner, as will be appreciated, there is no absolute need for a repairman to enter into the silo and he may thus avoid the very real danger that this represents, as explained above.

In the case of the compacted loosening chain assemblies to be secured at the lower end of the rotary post 13, resort may be had to the standard procedure as shown in 41 of fixedly securing one end of the chains directly onto the post. When any repair or replacement is required, it is recommended that a solid wood or metal bridge be positioned between the bottom 5 of the silo and the post 13, as illustrated by the dotted line 51 in FIG. 1. The repairman may then lie beneath this bridge 51 and thereby protect himself should the aforementioned bridge of compacting material break and suddenly and rapidly fill the space 53.

I claim:

1. In a silo constructed for bottom unloading, the combination comprising:

a post vertically extending from the bottom of said silo;

a compacted material loosening chain having a predetermined transverse size;

a ring mounted at one end of said chain, said ring having a diameter greater than said chain transverse size;

means defining a passage across said post, said passage having a diameter greater than said ring diameter;

stop means, within said passage, said stop means having a central bore with a diameter smaller than said ring diameter and greater than said chain transverse size;

a threading needle and means removably mounting the other end of said chain to one of said needle, said threading needle having a diameter smaller than the diameter of said stop means central bore, wherein said chain extends out of said passage from one end of said passage and said ring lies within said passage in abutment against said stop means.

2. A combination as claimed in claim 1, wherein said means removably mounting said chain on said end of said needle is a hook secured to said end of said needle, a last one of the links of said chain being removably held onto said hook.

3. A combination as claimed in claim 1, further comprising an intertia block removably secured at the other end of said chain to assist in loosening material loaded into said silo.

4. A combination as claimed in claim 1, wherein said passage defining means comprises a first sleeve secured across said post.

5. A combination as claimed in claim 4, wherein said stop means is a second sleeve secured within said first sleeve, coaxially therewith, said sleeves defining a shoulder therebetween against which said ring abuts.

6. A combination as claimed in claim 1, wherein said ring is circular in cross-section.

7. A method of removably mounting a compact-material loosening chain having a predetermined transverse size on a post vertically extending from a ground elevated bottom of a silo constructed for bottom unloading by a discharge assembly, the said elevated bottom having an access opening adjacent the discharge assembly, said method comprising:

mounting, from the outside of said silo and at one end of said chain, a ring having a predetermined diameter greater than said chain transverse size;

providing, across said post, a first passage followed by a second passage coaxial with said first passage; said first passage having a diameter greater than said ring diameter and said second passage having a diameter smaller than said ring diameter and greater than said chain transverse size; said passage thus defining a stop shoulder therebetween for abutment of said ring;

providing a threading needle having a diameter smaller than the diameter of said second passage and being formed with a transverse through hole at one end thereof;

removably mounting, from the outside of said silo, one end of said chain to the other end of said needle;

providing an elongated pole having a hook located short of one end thereof;

removably mounting, from the outside of said silo, said other end of said needle to said one end of said pole;

inserting said one end of said pole in said silo, through said opening, with said needle removably mounted thereon and said one end of said chain removably mounted on said other end of said needle;

sliding said needle through said passages with said needle one end first;

removing said pole from said needle;

hooking said hook of said pole on said needle transverse hole and drawing on said needles, with said pole, to thread said chain through said passages until said ring butts against said stop shoulder and said chain hangs from said post; said chain having a length suitable to allow said other end of said chain to then stand by said opening, and removing said needle from said chain other end and mounting an inertia block at said chain other end.

8. A method as claimed in claim 7, further comprising rotating said post, after removing said pole from said needle, to make said transverse hole of said needle available for said hook of said pole.

9. A method as claimed in claim 8, wherein said rotation is through essentially 180°.

* * * * *